US007161305B2

(12) United States Patent
Chen

(10) Patent No.: US 7,161,305 B2
(45) Date of Patent: Jan. 9, 2007

(54) METHOD AND APPARATUS FOR SINGLE-ENDED CONVERSION OF DC TO AC POWER FOR DRIVING DISCHARGE LAMPS

(75) Inventor: Wei Chen, Campbell, CA (US)

(73) Assignee: Monolithic Power Systems, Inc., Los Gatos, CA (US)

( * ) Notice: Subject to any disclaimer, the term of this patent is extended or adjusted under 35 U.S.C. 154(b) by 86 days.

(21) Appl. No.: 10/850,351

(22) Filed: May 19, 2004

(65) Prior Publication Data

US 2005/0258778 A1 Nov. 24, 2005

(51) Int. Cl.
*H05B 37/02* (2006.01)

(52) U.S. Cl. ..... 315/209 R; 315/219; 315/307

(58) Field of Classification Search ..... 315/209 R, 315/219, 224, 244, 291, 307, DIG. 7
See application file for complete search history.

(56) References Cited

U.S. PATENT DOCUMENTS 4,257,088 A 3/1981 Nilssen ..... 363/18
RE32,155 E 5/1986 Nilssen ..... 363/18
5,063,331 A * 11/1991 Nostwick ..... 315/219
5,677,602 A * 10/1997 Paul et al. ..... 315/224
5,907,223 A * 5/1999 Gu et al. ..... 315/247
6,031,342 A * 2/2000 Ribarich et al. ..... 315/291
6,072,710 A * 6/2000 Chang ..... 363/132

* cited by examiner

*Primary Examiner*—Thuy V. Tran
*Assistant Examiner*—Jimmy Vu
(74) *Attorney, Agent, or Firm*—Perkins Coie LLP

(57) ABSTRACT

The present disclosure introduces a simple method and apparatus for converting DC power to AC power, and, specifically, to single-ended inverter circuits for driving discharge lamps such as a Cold Cathode Fluorescent Lamp (CCFL) or an External Electrode Fluorescent Lamp (EEFL). Among other advantages, these circuits offer nearly symmetrical voltage waveform to drive discharge lamps when the duty cycle is close to 50%. They also eliminate the high current and high voltage resonant capacitor on the primary side, and reduce the voltage rating of a primary switch to twice the input voltage without the need for snubber circuits. The recommended inverters can be used to efficiently drive discharge lamps at low cost, particularly for applications with a narrow input voltage range. The lamp current can be regulated through the duty cycle modulation of the main switch.

36 Claims, 8 Drawing Sheets

METHOD AND APPARATUS FOR SINGLE-ENDED CONVERSION OF DC TO AC POWER FOR DRIVING DISCHARGE LAMPS

TECHNICAL FIELD

The present invention relates to a method and apparatus for converting DC power to AC power, and, more particularly, to single-ended conversion for driving discharge lamps.

BACKGROUND

Most small Cold Cathode Fluorescent Lamps (CCFLs) are used in battery powered systems. The system battery supplies a direct current (DC) to an input of a DC to AC inverter. A common technique for converting a relatively low DC input voltage to a higher AC output voltage is to chop up the DC input signal with power switches, filter out the harmonic signals produced by the chopping, and output a sine-wave-like AC signal. The voltage of the AC signal is stepped up with a transformer to a relatively high voltage since the running voltage could be 500 volts over a range of 0.5 to 6 milliamps. CCFLs are usually driven by AC signals having frequencies that range from 50 to 100 kilohertz.

The power switches may be bipolar junction transistors (BJT) or Field Effect Transistors (FET or MOSFET). Also, the transistors may be discrete or integrated into the same package as the control circuitry for the DC to AC converter. Since resistive components tend to dissipate power and reduce the overall efficiency of a circuit, a typical harmonic filter for a DC to AC converter employs inductive and capacitive components that are selected to minimize power loss. A second-order resonant filter formed with inductive and capacitive components is referred to as a "tank" circuit, since the tank stores energy at a particular frequency.

The average life of a CCFL depends on several aspects of its operating environment. For example, driving the CCFL at a higher power level than its rating reduces the useful life of the lamp. Also, driving the CCFL with an AC signal that has a high crest factor can cause premature failure of the lamp. The crest factor is the ratio of the peak current to the average current that flows through the CCFL.

On the other hand, it is known that driving a CCFL with a relatively high frequency square-shaped AC signal maximizes the useful life of the lamp. However, since the square shape of an AC signal may cause significant interference with another circuit disposed in the immediate vicinity of the circuitry driving the CCFL, the lamp is typically driven with an AC signal that has a less than optimal shape such as a sine-shaped AC signal.

Double-ended (full-bridge and push-pull) inverter topologies are popular in driving today's discharge lamps because they offer symmetrical voltage and current drive on both positive and negative cycles. The resulting lamp current is sinusoidal and has a low crest factor. These topologies are very suitable for applications with a wide DC input voltage range.

The cost of double-ended designs, however, remains a main concern for low power and regulated input applications. Full-bridge circuits require four power switches and complicated drive circuits. Push-pull inverters require two power switches whose voltage rating must be greater than twice input voltage, and use a snubber circuit to suppress the leakage inductance-related ringing, where a snubber circuit is connected around a power device for altering its switching trajectory, usually for reducing power loss in the power device.

Single-ended inverters are therefore considered for a low-power and cost-sensitive application. Traditional single-ended inverters do not offer the symmetrical voltage waveform to drive the lamp, even if the duty cycle is close to 50%. In addition, the traditional circuit requires an expensive high voltage and high current resonant capacitor on the primary side and high voltage MOSFET to sustain the resonant voltages. Therefore, the traditional single-ended inverters do not offer a significant cost advantage over the double-ended inverters in addition to the fact that their performance is not as good. There is a need for single-ended inverters to efficiently drive discharge lamps at low cost, particularly for applications with a narrow input voltage range.

BRIEF DESCRIPTION OF THE DRAWINGS

The foregoing aspects and many of the attendant advantages of the invention will become more readily appreciated as the same become better understood by reference to the following detailed description, when taken in conjunction with the accompanying drawings, wherein.

DETAILED DESCRIPTION

The present invention relates to inverter circuits and methods for converting DC power to AC power, and, specifically, to single-ended inverter circuits for driving discharge lamps such as Cold Cathode Fluorescent Lamps (CCFLs). The proposed circuits offer, among other advantages, nearly symmetrical voltage waveform to drive discharge lamps when the duty cycle is close to 50%.

They also eliminate a high current and high voltage resonant capacitor on the primary side, and reduce the voltage rating of a primary switch to twice input voltage without the need for snubber circuits. The recommended circuits can be used to efficiently drive discharge lamps at low cost, particularly for applications with narrow input voltage range. The lamp current can be regulated through the duty cycle modulation of the main switch or varying the frequency.

In the following description, several specific details are presented to provide a thorough understanding of the embodiments of the invention. One skilled in the relevant art will recognize, however, that the invention can be practiced without one or more of the specific details, or in combination with or with other components, etc. In other instances, well-known implementations or operations are not shown or described in detail to avoid obscuring aspects of various embodiments of the invention.

Reference throughout the specification to "one embodiment" or "an embodiment" means that a particular feature, structure, implementation, or characteristic described in connection with the embodiment is included in at least one embodiment of the present invention. Thus, uses of the phrases "in one embodiment" or "in an embodiment" in various places throughout the specification are not necessarily all referring to the same embodiment. Furthermore, the particular features, structures, implementation, or characteristics may be combined in any suitable manner in one or more embodiments.

Figure 1A:
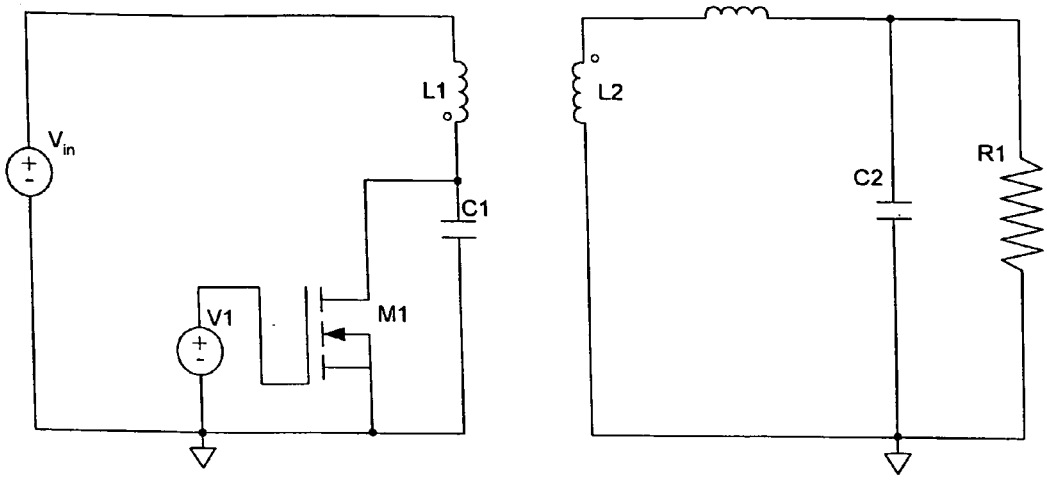
FIG. 1A PRIOR ART
FIG. 1A is a schematic circuit diagram of a traditional DC to AC inverter.

FIG. 1A is a schematic circuit diagram of a traditional DC to AC inverter, in which R1 represents the load. While this circuit requires an expensive high voltage and high current resonant capacitor on the primary side and a high voltage MOSFET to sustain the resonant voltages, it does not offer a symmetrical voltage waveform to drive the lamp, even when the duty cycle is close to 50%.

Figure 1B:
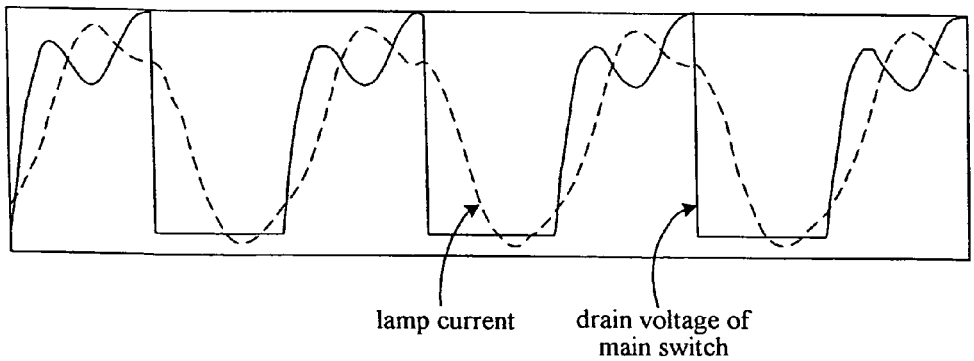
FIG. 1B PRIOR ART
FIG. 1B is the experimental result of the behavior of the traditional inverter circuit of FIG. 1A, with a duty cycle close to 50%.

FIG. 1B depicts the experimental results of the traditional circuit of FIG. 1A.

Figure 2A:
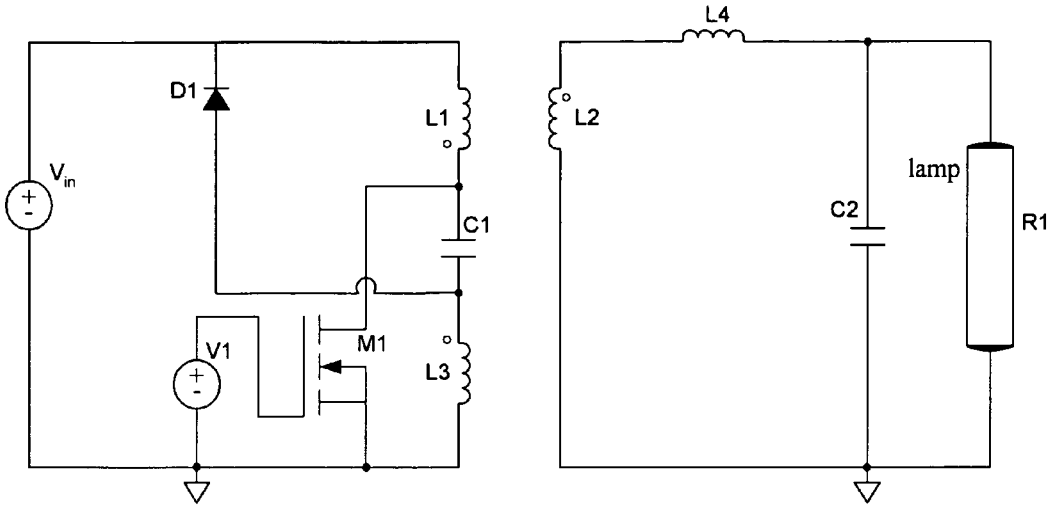
FIG. 2A is a schematic circuit diagram of a DC to AC inverter, in accordance with an embodiment of the present invention.

FIG. 2A is a schematic circuit diagram of a DC to AC inverter in accordance with an embodiment of the present invention. In this embodiment L1, L2, and L3 form a 3-winding transformer. When a main switch M1 turns on, the input source energy and the energy stored in a primary side capacitor C1 are delivered to the secondary side. The current through the main switch M1 is the sum of the magnetizing inductance current of the transformer and the reflected resonant inductor current in L4. In this situation a primary side diode D1 is off.

When the main switch M1 turns off, the reflected L4 current flows through the diode D1 to continue its resonance. The drain voltage of the main switch M1 is then brought up to $V_{in}+V_c$, where $V_c$ is the voltage across the capacitor C1. Usually C1 is designed to be large enough so that $V_c$ is almost constant and equal to $V_{in}$. Therefore, the maximum voltage stress on the main switch is about $2V_{in}$. The current through the diode D1 is the sum of the magnetizing current and the reflected resonant inductor (L4) current. Because L4 current changes polarity, at times the net current through the diode D1 will decrease to zero. The drain voltage of the main switch M1 may also decrease to $V_{in}$ and oscillate around this level. The oscillation can be caused by the leakage inductance between the two primary windings and the parasitic capacitance on the primary side.

Figure 2B:
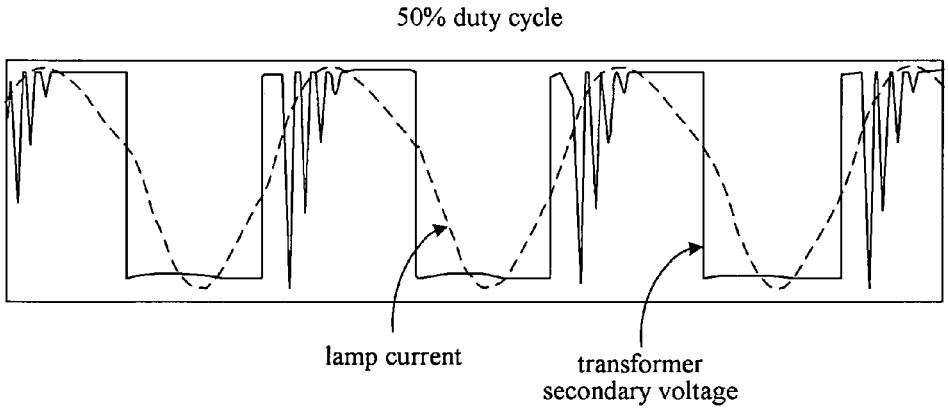
FIGS. 2B and 2C are the experimental results of the behavior of the inverter circuit depicted in FIG. 2A, with duty cycles of 50% and 30%, respectively.
Figure 2C:
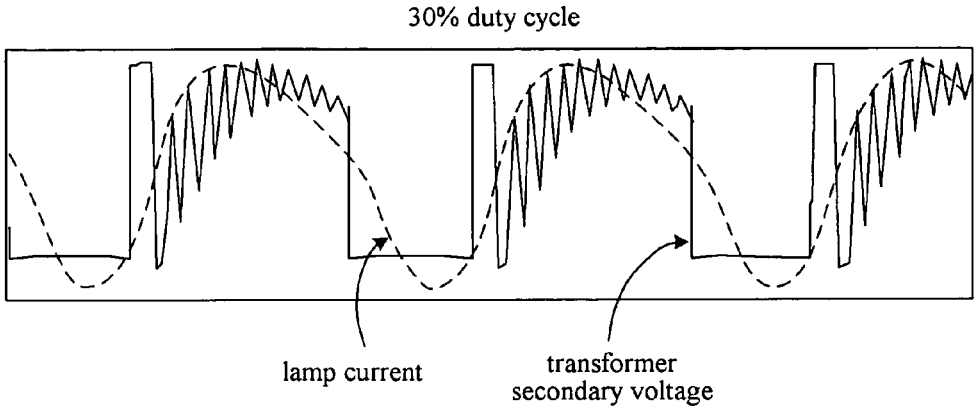

As evident from the waveforms of FIG. 2B, at close to 50% duty cycle the voltage drive waveform for the resonant tank L4, C1 and R1 are fairly symmetrical around zero. Consequently, the lamp current (through R1) is very close to sinusoidal. The circuit of FIG. 2A can be used for driving an External Electrode Fluorescent Lamp (EEFL), which integrates a series capacitor into the circuit. FIG. 2C depicts the behavior of this circuit at a 30% duty cycle.

Figure 3A:
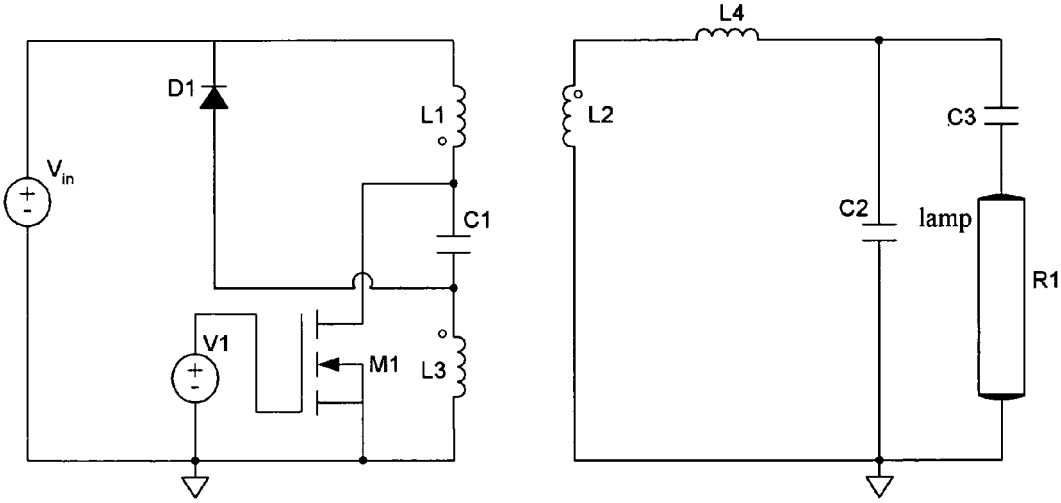
FIG. 3A is a schematic circuit diagram of a DC to AC inverter, in accordance with an embodiment of the present invention.
Figure 3B:
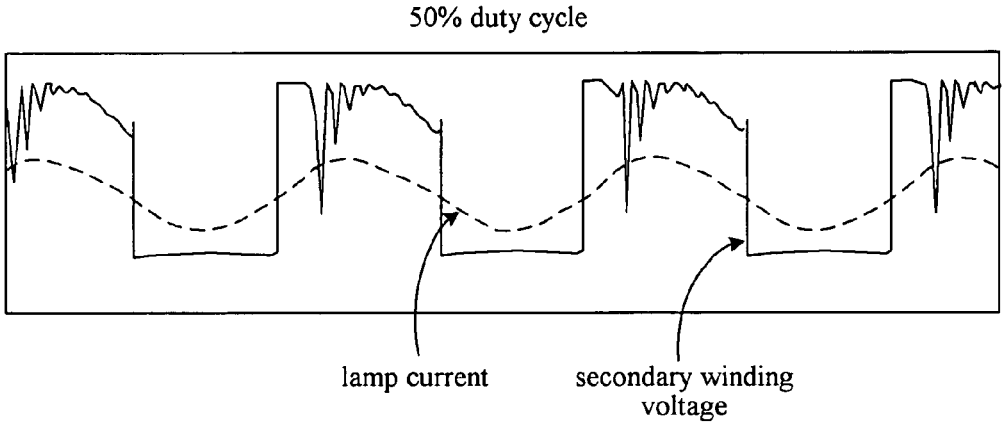
FIGS. 3B, 3C, and 3D are the experimental results of the behavior of the inverter circuit depicted in FIG. 3A, with duty cycles of 50%, 45% and 30%, respectively.
Figure 3C:
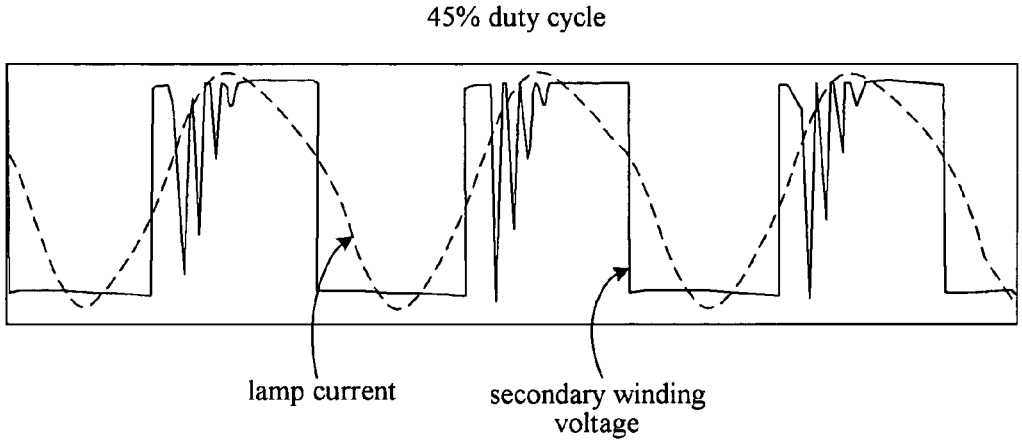
Figure 3D:
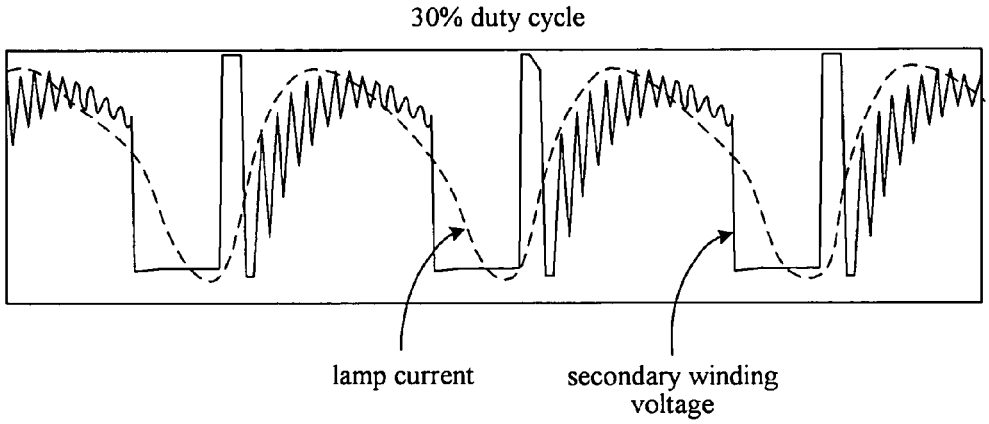

Lamps like CCFL do not allow any DC current. It is desirable to add a ballast capacitor (C3) in series with the lamp. The circuit and its experimental waveforms are shown in FIG. 3. Sometimes, the ballast capacitor is also used for balancing current in the multi-lamp applications. FIGS. 3B, 3C, and 3D show that the lamp current amplitude at a 30% or 45% duty cycle is lower than that of a 50% duty cycle. Thus the lamp current can be regulated through the duty cycle of the main switch.

For high-power applications, the current through the diode D1 may be large enough to overheat the diode D1 by its power loss. In this case, it is desirable to replace the diode D1 with a low RDSon MOSFET, where RDSon stands for the resistance from the drain to the source when the MOSFET is fully switched on.

Figure 4A:
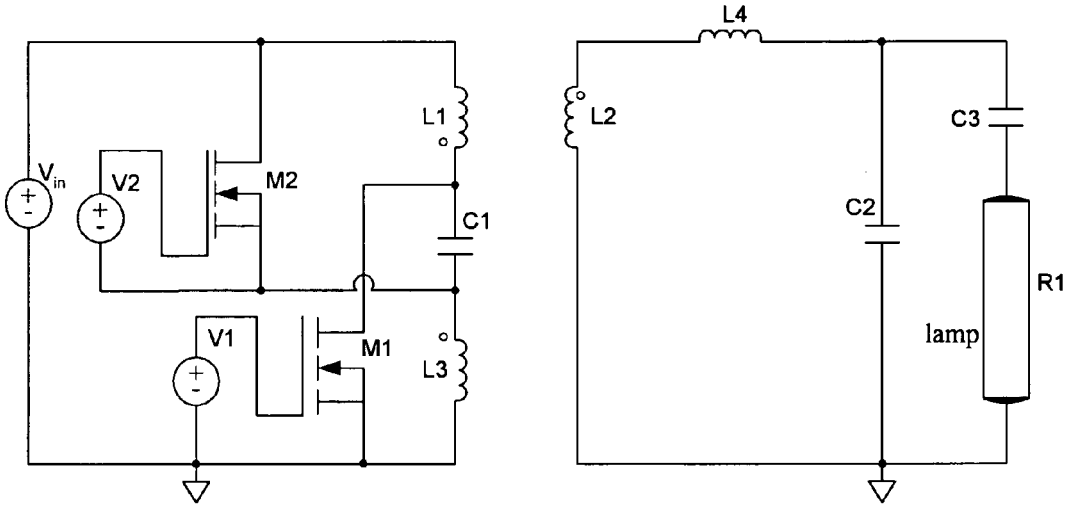
FIG. 4A is a schematic circuit diagram of a DC to AC inverter, in accordance with an embodiment of the present invention.
Figure 4B:
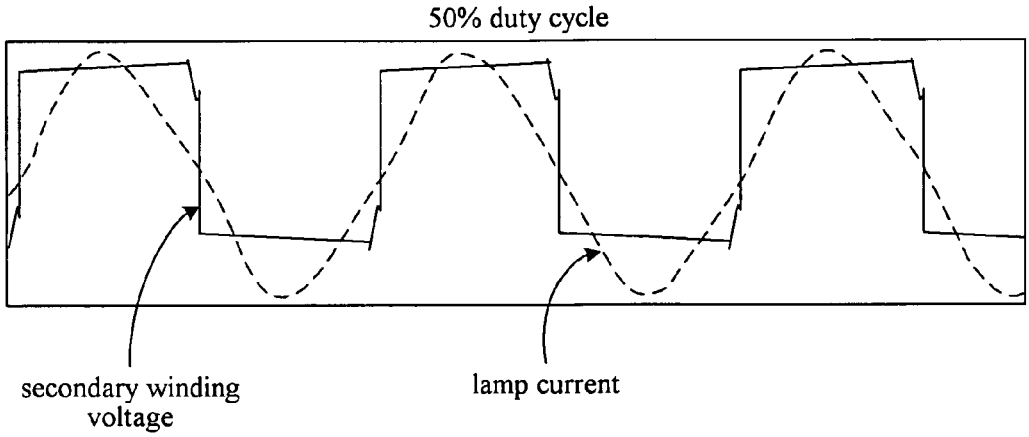
FIGS. 4B, 4C and 4D are the experimental result of the behavior of the inverter circuit depicted in FIG. 4A, with duty cycles of 50%, 45% and 25%, respectively.
Figure 4C:
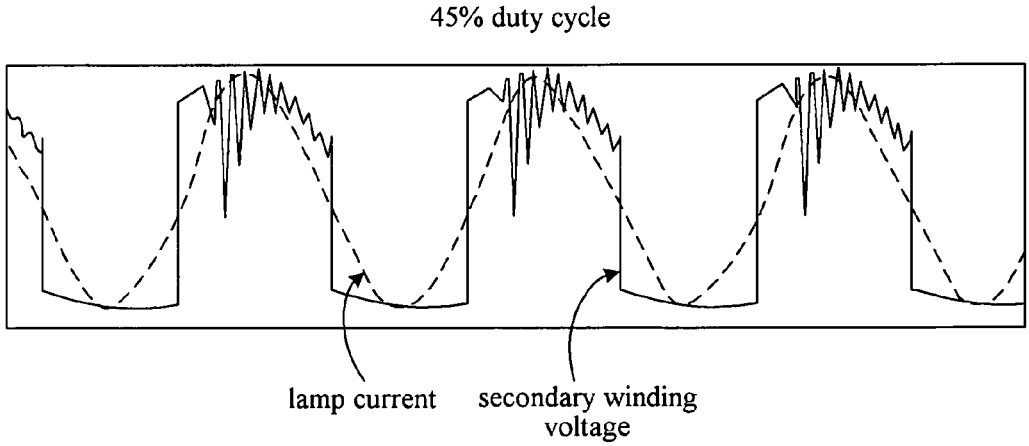
Figure 4D:
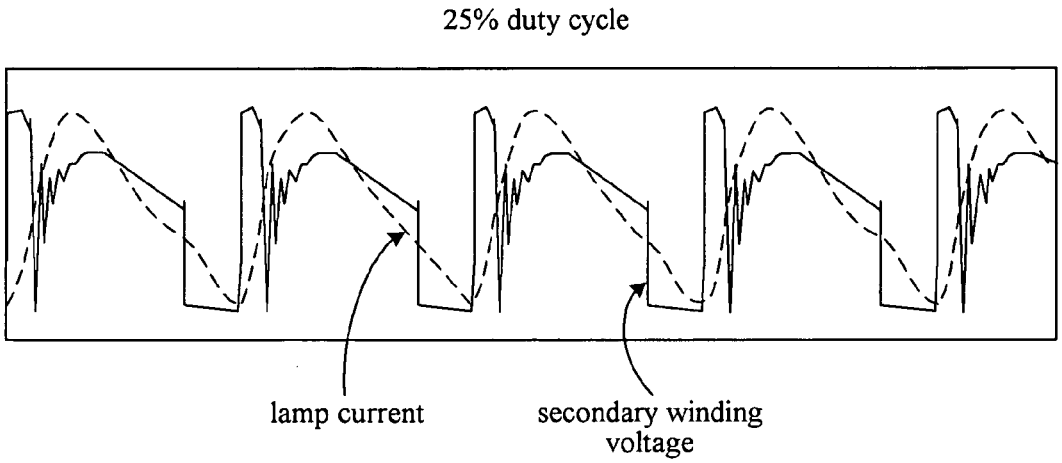

FIG. 4A shows an arrangement in which the diode D1 is replaced with the low RDSon MOSFET (M2). The gate control of an M2 can be implemented in several ways. One way is to turn on the M2 only when the current flows from the source to the drain. The resulting circuit will be similar to basic circuits shown above except that the power loss is decreased. The other way is to turn on the M2 for the same ON time as the main switch M1. Also interleave the M1 and M2 pulses like in a push-pull inverter. The resulting circuit will achieve the same symmetrical voltage and current drive for the resonant tank as the push-pull circuit. In addition, the voltage stress of the M1 and M2 switches will never exceed $2V_{in}$, and no snubber is needed. FIGS. 4B, 4C, and 4D depict the behavior of the circuit of FIG. 4 under different conditions.

Figure 5:
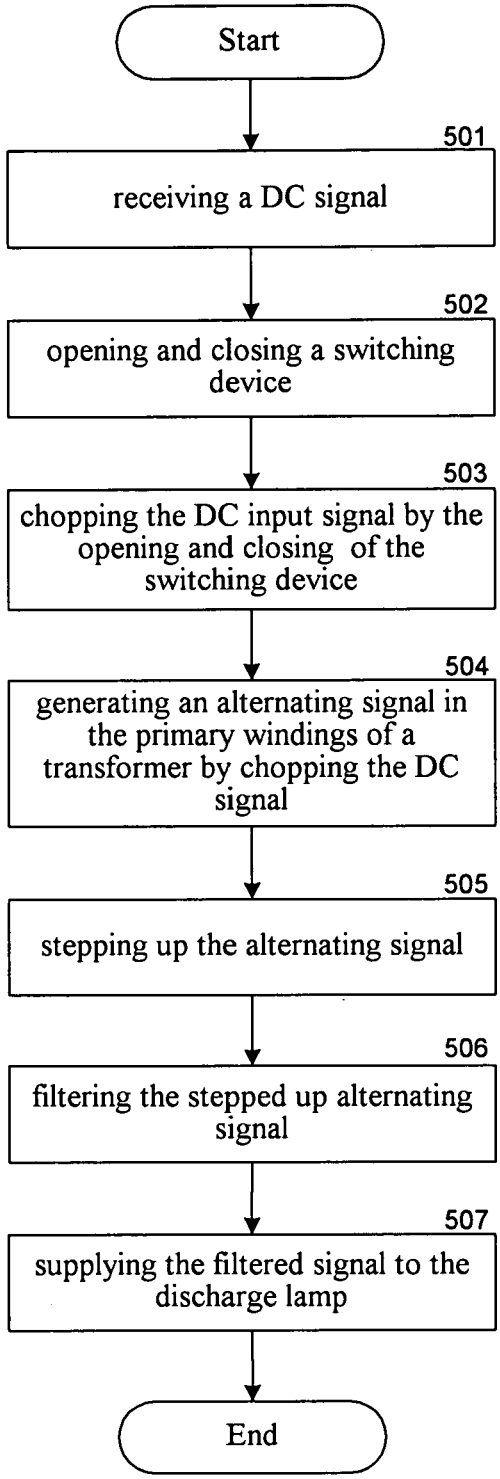
FIG. 5 is a flow diagram of the DC to AC inversion method, in accordance with an embodiment of the present invention.

FIG. 5 is a flow diagram of the DC to AC inversion method, in accordance with an embodiment of the present invention. At step 501 a single-ended inverter circuit is provided with a DC input signal. At step 502 a resonant sub-circuit, with the energy provided by the DC signal, opens and closes a switching device such as a MOSFET. At step 503 the switching device chops a DC signal periodically. At step 504 the chopping of the DC signal generates an alternating signal within the primary windings of the transformer part of the inverter circuit. At step 505 the alternating signal of the primary windings of the transformer is stepped-up by the transformer's secondary winding. At step 506 the stepped up signal is filtered before being supplied to the discharge lamp. At step 507 the filtered stepped-up alternating signal is provided to the discharge lamp.

The preferred and several alternate embodiments have thus been described. After reading the foregoing specification, one of ordinary skill will be able to effect various changes, alterations, combinations, and substitutions of equivalents without departing from the broad concepts disclosed. It is therefore intended that the scope of the letters patent granted hereon be limited only by the definitions contained in the appended claims and equivalents thereof, and not by limitations of the embodiments described herein.

I claim:

1. An apparatus for converting a direct current (DC) signal into an alternating current (AC) signal, comprising:

a network of at least one switch for generating an AC signal from a DC signal, the AC signal being generated by a first portion of the network periodically opening and closing;

filtering means being coupled between the network of the said at least one switch and the load, the filtering means filtering the AC signal delivered to the load, wherein the filtering means includes a transformer having at least one primary winding that receives the AC signal from the network of the said at least one switch and having a secondary winding that is coupled to the load, and wherein a diode is in series with the at least one primary winding of the transformer; and impedance means coupled to said at least one transformer primary winding to form a resonant circuit for periodically opening and closing the switch, generally at a resonant frequency of the filtering means, so that alternating electrical power is supplied to the load under a range of voltages provided by the DC signal.

2. The apparatus of claim 1, wherein the load is a discharge lamp.

3. The apparatus of claim 1, wherein the load is a Cold Cathode Fluorescent Lamp (CCFL).

4. The apparatus of claim 1, wherein the load is an External Electrode Fluorescent Lamp (EEFL).

5. The apparatus of claim 1, wherein the filter is disposed between a secondary winding of the transformer and the load.

6. The apparatus of claim 1, wherein the filter is a second order filter that includes an inductance component and a capacitance component.

7. The apparatus of claim 1, wherein the filter is a second order filter that includes an inductance component and a capacitance component, the inductance being provided by the transformer.

8. The apparatus of claim 1, wherein the filter is a second order filter that includes an inductance component, a first capacitance component, and a second capacitance component, the second capacitance component being in series with the load.

9. The apparatus of claim 1, wherein the DC signal has a narrow voltage range.

10. The apparatus of claim 1, wherein the load current is regulated through the duty cycle of the switch.

11. The apparatus of claim 1, wherein the load current is regulated by changing the frequency.

12. The apparatus of claim 1, wherein the switch is a MOSFET.

13. The apparatus of claim 1, wherein the transformer has two primary windings.

14. The apparatus of claim 1, wherein a semiconductor device, different from the switching component, is in series with one primary winding of the transformer.

15. The apparatus of claim 13, wherein said two primary windings are coupled by a capacitor.

16. An apparatus for converting a direct current (DC) signal into an alternating current (AC) signal for operating at least one electrical discharge lamp, comprising:

a single-ended network of at least one semiconductor device for generating an AC signal from a DC input signal, the AC signal being generated by a first portion of the network periodically opening and closing;

filtering means being coupled between the network of the said at least one semiconductor device and the load, the filtering means filtering the AC signal delivered to the load, wherein the filtering means includes a step-up transformer having two primary windings that receive the AC signal from the network of said at least one semiconductor device and having a secondary winding that is coupled to the load, and wherein the filtering means further includes a capacitor in parallel with the load, and wherein the filtering means is a second order filter that includes an inductance component, a first capacitance component, and a second capacitance component, the second capacitance component being in series with the load; and impedance means coupled to said transformer primary windings to form a resonant circuit for periodically opening and closing the switch, generally at a resonant frequency of the filtering means, so that alternating electrical power is supplied to the load under a range of voltages provided by the DC input signal.

17. The apparatus of claim 16, wherein the discharge lamp is a Cold Cathode Fluorescent Lamp (CCFL).

18. The apparatus of claim 16, wherein the discharge lamp is an External Electrode Fluorescent Lamp (EEFL).

19. The apparatus of claim 16, wherein the filter is disposed between a secondary winding of the step-up transformer and the load.

20. The apparatus of claim 16, wherein the filter is a second order filter that includes an inductance component and a capacitance component.

21. The apparatus of claim 16, wherein the filter is a second order filter that includes an inductance component and a capacitance component, the inductance being provided by the transformer.

22. The apparatus of claim 16, wherein the DC signal has a narrow voltage range.

23. The apparatus of claim 16, wherein the load current is regulated through the duty cycle of the switch.

24. The apparatus of claim 16, wherein the load current is regulated by changing the frequency.

25. The apparatus of claim 16, wherein the semiconductor device is a MOSFET.

26. The apparatus of claim 16, wherein a diode is in series with one primary winding of the transformer.

27. The apparatus of claim 16, wherein a MOSFET, different from the switching semiconductor device, is in series with one primary winding of the transformer.

28. The apparatus of claim 16, wherein said two primary windings are coupled by a capacitor.

29. A method of converting a direct current (DC) signal into an alternating current (AC) signal for operating at least one electrical discharge lamp, the method comprising:

receiving a DC signal;

opening and closing a switching device by a resonant circuit using the DC signal;

chopping the DC input signal by the opening and closing of the switching device;

generating an alternating signal in primary windings of a transformer by chopping the DC signal, wherein a diode is in series with at least one primary winding of the transformer;

stepping up the alternating signal of the transformer's primary winding into its secondary winding;

filtering the stepped-up alternating signal; and supplying the filtered signal to the discharge lamp.

30. The method of claim 29, wherein the DC signal is received by a single-ended circuit.

31. The method of claim 29, wherein switching is done by a MOSFET.

32. The method of claim 29, wherein the step-up transformer has two primary windings.

33. The method of claim 29, wherein filtering is done by a second order filter that includes an inductance component and a capacitance component.

34. The method of claim 29, wherein filtering is done by a second order filter that includes an inductance component and a capacitance component, and a second capacitance component, the inductance being provided by the step-up transformer.

35. An apparatus for converting a direct current (DC) signal into an alternating current (AC) signal, comprising:

a network of at least one switch for generating an AC signal from a DC signal, the AC signal being generated by a first portion of the network periodically opening and closing;

filtering means being coupled between the network of said at least one switch and the load, the filtering means filtering the AC signal delivered to the load, wherein the filtering means includes a transformer having at least one primary winding that receives the AC signal from the network of said at least one switch and having a secondary winding that is coupled to the load, and wherein the filter is a second order filter that includes an inductance component and a capacitance component, the inductance being provided by the transformer; and impedance means coupled to said at least one transformer primary winding to form a resonant circuit for periodically opening and closing the switch, generally at a resonant frequency of the filtering means, so that alternating electrical power is supplied to the load under a range of voltages provided by the DC signal.

36. An apparatus for converting a direct current (DC) signal into an alternating current (AC) signal, comprising:

a network of at least one switch for generating an AC signal from a DC signal, the AC signal being generated by a first portion of the network periodically opening and closing;

filtering means being coupled between the network of the said at least one switch and the load, the filtering means filtering the AC signal delivered to the load, wherein the filtering means includes a transformer having at least one primary winding that receives the AC signal from the network of the said at least one switch and having a secondary winding that is coupled to the load; and impedance means coupled to said at least one transformer primary winding to form a resonant circuit for periodically opening and closing the switch, generally at a resonant frequency of the filtering means, so that alternating electrical power is supplied to the load under a range of voltages provided by the DC signal; and a configuration wherein the load current is regulated through the duty cycle of the switch or by changing the frequency.

* * * * *